US009360000B2

(12) United States Patent
Simmons et al.

(10) Patent No.: US 9,360,000 B2
(45) Date of Patent: Jun. 7, 2016

(54) RECIPROCATING PUMPS AND RELATED METHODS

(75) Inventors: John M. Simmons, Marion, UT (US); Tom M. Simmons, Kamas, UT (US); David M. Simmons, Francis, UT (US); Kenji Allen Kingsford, Heber City, UT (US)

(73) Assignee: GRACO FLUID HANDLING (A) INC., Kamas, UT (US)

( * ) Notice: Subject to any disclaimer, the term of this patent is extended or adjusted under 35 U.S.C. 154(b) by 778 days.

(21) Appl. No.: 13/420,978

(22) Filed: Mar. 15, 2012

(65) Prior Publication Data

US 2013/0243630 A1 Sep. 19, 2013

(51) Int. Cl.
*F04B 23/02* (2006.01)

(52) U.S. Cl.
CPC ..... *F04B 23/028* (2013.01); *Y10T 29/49236* (2015.01)

(58) Field of Classification Search
CPC ..... F04B 23/028; F04B 39/00
USPC ..... 417/396, 398, 399, 401, 375; 251/333
See application file for complete search history.

(56) References Cited

U.S. PATENT DOCUMENTS

| | | | | |
|---|---|---|---|---|
| 4,483,665 | A * | 11/1984 | Hauser | 417/401 |
| 4,566,867 | A | 1/1986 | Bazan et al. | |
| 4,716,924 | A * | 1/1988 | Pacht | 137/327 |
| 5,370,507 | A | 12/1994 | Dunn | |
| 5,558,506 | A * | 9/1996 | Simmons et al. | 417/393 |
| 5,893,707 | A * | 4/1999 | Simmons et al. | 417/393 |
| 6,106,246 | A | 8/2000 | Steck et al. | |
| 6,295,918 | B1 | 10/2001 | Simmons et al. | |
| 6,685,443 | B2 | 2/2004 | Simmons et al. | |
| 6,874,997 | B2 * | 4/2005 | Watanabe et al. | 417/395 |
| 7,458,309 | B2 | 12/2008 | Simmons et al. | |
| 2010/0178184 | A1 | 7/2010 | Simmons et al. | |

FOREIGN PATENT DOCUMENTS

| | | | |
|---|---|---|---|
| EP | 1553296 | A1 | 7/2005 |
| JP | 3568866 | B2 | 9/2004 |
| WO | 9523924 | A1 | 9/1995 |

OTHER PUBLICATIONS

International Search Report and Written Opinion for PCT Application No. PCT/2013/021802, mailed May 14, 2013.

* cited by examiner

*Primary Examiner* — Charles Freay
*Assistant Examiner* — Lilya Pekarskaya
(74) *Attorney, Agent, or Firm* — TraskBritt

(57) ABSTRACT

Reciprocating fluid pumps include a pump body including a cavity therein, a plunger located at least partially within the cavity, and a shift canister assembly disposed within the cavity. The shift canister assembly includes a sealing surface for forming a seal against the pump body. An area covered by the seal between the sealing surface and the pump body is less than about 75% of an outer cross-sectional area of the shift canister assembly. The shift canister assembly may include a shift canister and a shift canister cap attached thereto, the shift canister cap comprising the sealing surface. Reciprocating fluid pumps include a shift canister, a shift piston at least partially disposed within the shift canister, and a shift canister cap attached to the shift canister on a longitudinal end of the shift canister opposite the shift piston. Methods include forming such reciprocating pumps.

26 Claims, 11 Drawing Sheets

RECIPROCATING PUMPS AND RELATED METHODS

TECHNICAL FIELD

Embodiments of the present invention relate generally to reciprocating fluid pumps that include a shift canister assembly, to components for use with such pumps, and to methods of forming such reciprocating fluid pumps and components.

BACKGROUND

Reciprocating fluid pumps are used in many industries. Reciprocating fluid pumps generally include two subject fluid chambers in a pump body. A reciprocating piston or shaft is driven back and forth within the pump body. One or more plungers (e.g., diaphragms or bellows) may be connected to the reciprocating piston or shaft. As the reciprocating piston moves in one direction, the movement of the plungers results in subject fluid being drawn into a first chamber of the two subject fluid chambers and expelled from the second chamber. As the reciprocating piston moves in the opposite direction, the movement of the plungers results in fluid being expelled from the first chamber and drawn into the second chamber. A fluid inlet and a fluid outlet may be provided in fluid communication with the first subject fluid chamber, and another fluid inlet and another fluid outlet may be provided in fluid communication with the second subject fluid chamber. The fluid inlets to the first and second subject fluid chambers may be in fluid communication with a common single pump inlet, and the fluid outlets from the first and second subject fluid chambers may be in fluid communication with a common single pump outlet, such that subject fluid may be drawn into the pump through the pump inlet from a single fluid source, and subject fluid may be expelled from the pump through a single pump outlet. Check valves may be provided at the fluid inlets and outlets to ensure that fluid can only flow into the subject fluid chambers through the fluid inlets, and fluid can only flow out of the of the subject fluid chambers through the fluid outlets.

Conventional reciprocating fluid pumps operate by shifting the reciprocating piston back and forth within the pump body. Shifting of the reciprocating piston from one direction to the other may be accomplished by using a shuttle valve, which provides drive fluid (e.g., pressurized air) to a first drive chamber associated with a first plunger and then shifts the drive fluid to a second drive chamber associated with a second plunger as the first plunger reaches a fully extended position. The shuttle valve includes a spool that shifts from a first position that directs the drive fluid to the first drive chamber to a second position that directs the drive fluid to the second drive chamber. Shifting of the shuttle valve spool may be accomplished by providing fluid communication between the drive chamber and a shift conduit when each plunger is fully extended, which enables the drive fluid to pressurize the shift conduit to shift the shuttle valve spool from one position to the other. During the rest of the pumping stroke, however, the opening to the shift conduit is kept sealed from the drive chamber to keep the shuttle valve spool from prematurely shifting and to improve the efficiency of the reciprocating fluid pump.

The opening to the shift conduit may be sealed and, at the end of each pumping stroke, unsealed from the drive chamber by use of a so-called "shift canister." The conventional shift canister is generally cylindrical with a sealing surface on the end thereof closest to the shift conduit. The sealing surface end is integral with sidewalls of the shift canister. The interior of the shift canister is hollow for disposing an end of a shift piston therein. A shift canister cap is attached to an end of the shift canister opposite the sealing surface using, for example, threads. The shift canister cap includes a hole through which the shift piston extends. The shift canister cap has an inner diameter that is smaller than an inner diameter of the shift canister sidewalls. The shift piston includes an enlarged end that has a larger diameter than the inner diameter of the shift canister cap so that, when the plunger approaches a fully extended position, the shift piston abuts against the shift canister cap and pulls the shift canister to unseal the opening to the shift conduit.

Examples of reciprocating fluid pumps and components thereof are disclosed in, for example: U.S. Pat. No. 5,370,507, which issued Dec. 6, 1994 to Dunn et al.; U.S. Pat. No. 5,558,506, which issued Sep. 24, 1996 to Simmons et al.; U.S. Pat. No. 5,893,707, which issued Apr. 13, 1999 to Simmons et al.; U.S. Pat. No. 6,106,246, which issued Aug. 22, 2000 to Steck et al.; U.S. Pat. No. 6,295,918, which issued Oct. 2, 2001 to Simmons et al.; U.S. Pat. No. 6,685,443, which issued Feb. 3, 2004 to Simmons et al.; U.S. Pat. No. 7,458,309, which issued Dec. 2, 2008 to Simmons et al.; and U.S. Patent Application Publication No. 2010/0178184 A1, which published Jul. 15, 2010 in the name of Simmons et al. The disclosure of each of these patents and patent application is respectively incorporated herein in its entirety by this reference.

In conventional reciprocating pumps, the force required to unseal the opening of the shift conduit causes wear and even failure of the pump through breakage or deformation of the shift piston, the shift canister cap, or the shift canister. The position of the shift canister cap requires the shift piston to press directly against the shift canister cap proximate the threaded connection thereof, which may cause deformation, wear, and failure of the threaded connection. To avoid such wear or failure, the reciprocating pumps are driven at a reduced drive fluid pressure to reduce the sealing force that must be overcome to unseal the opening to the shift conduit. However, reducing the drive fluid pressure limits the rate at which subject fluid can be pumped. Additionally, conventional shift canisters may include bores longitudinally extending through the sidewalls of the shift canisters for providing fluid communication between the drive fluid chamber and the sealing surface end for directing sufficient drive fluid to the shift conduit for shifting the shuttle valve at the end of a stroke. Forming such bores takes time and resources that add to the manufacturing cost of the reciprocating pumps. Furthermore, an interface between the outer surface of the conventional shift canister and the surrounding pump body is often subject to wear and causes increased friction forces, which can further aggravate the problems described above or contribute to a separate mode of failure. Accordingly, the inventors have recognized the need for improved reciprocating pumps and associated shifting mechanisms.

SUMMARY

In one embodiment, the present disclosure includes a reciprocating pump for pumping a subject fluid, the reciprocating pump including a pump body with at least one cavity therein, at least one plunger located at least partially within the at least one cavity, and at least one shift canister assembly disposed within the cavity. The at least one plunger is configured to expand and compress in a reciprocating action to pump subject fluid through at least one subject fluid chamber within the at least one cavity during operation of the reciprocating pump. The at least one shift canister assembly includes a sealing surface configured to contact the pump body to form a seal between the sealing surface and the pump body during operation of the reciprocating pump. An area encompassed by a periphery of an area of contact between the sealing surface and the pump body, when sealed during operation of the reciprocating pump, is less than about 75% of an area encompassed by a periphery of a cross-section of the shift canister assembly.

In another embodiment, the present disclosure includes a reciprocating pump for pumping a subject fluid, the reciprocating pump including a pump body, a shift conduit, and a shift canister assembly within a drive fluid chamber within the pump body. The shift conduit extends at least between an exterior of the pump body and the drive fluid chamber. The shift canister assembly is configured to seal against the pump body to isolate the shift conduit from the drive the drive fluid chamber for a portion of a cycle of the reciprocating pump. A shifting force required to overcome the seal between the shift canister and the pump body is less than about 50 lbs (222 N) throughout an operating drive fluid pressure range extending from about 60 psi (414 kPa) to about 100 psi (689 kPa).

In another embodiment, the present disclosure includes a reciprocating fluid pump including a shift canister, a shift piston at least partially disposed within the shift canister, and a shift canister cap attached to the shift canister on a longitudinal end of the shift canister opposite the shift piston.

In another embodiment, the present disclosure includes a reciprocating fluid pump including a pump body, a drive fluid chamber within the pump body, and a shift canister assembly within the drive fluid chamber for shifting flow of drive fluid during operation of the reciprocating fluid pump. The shift canister assembly includes a first longitudinal portion that has a first outer circumference and a second longitudinal portion that has a second outer circumference that is less than the first outer circumference.

In another embodiment, the present disclosure includes a method for forming a reciprocating fluid pump. The method includes disposing an enlarged end of a shift piston within a shift canister and passing another end of the shift piston opposite the enlarged end through a longitudinal end of the shift canister to couple the shift piston to the shift canister. The another end of the shift piston opposite the enlarged end is coupled to a plunger. A shift canister cap is attached to an end of the shift canister opposite the longitudinal end through which the another end of the shift piston is passed, the shift canister cap comprising a sealing surface. The shift piston, shift canister, shift canister cap, and plunger may be disposed within a cavity of a pump body. The shift canister may be formed to have substantially solid sidewalls lacking a longitudinal bore therethrough, and the shift canister cap may be formed to include at least one through hole extending from a side thereof comprising the sealing surface to another, opposite side of the shift canister cap.

DETAILED DESCRIPTION

The illustrations presented herein may not be, in some instances, actual views of any particular reciprocating fluid pump or component thereof, but may be merely idealized representations that are employed to describe embodiments of the present invention. Additionally, elements common between drawings may retain the same numerical designation.

As used herein, the term "substantially" means to a degree that one skilled in the art would understand the given parameter, property, or condition is met with a small degree of variance, such as within acceptable manufacturing tolerances.

As used herein, any relational term, such as "first," "second," "over," "under," "on," etc., is used for clarity and convenience in understanding the disclosure and accompanying drawings and does not connote or depend on any specific preference, orientation, or order, except where the context clearly indicates otherwise.

Figure 1:
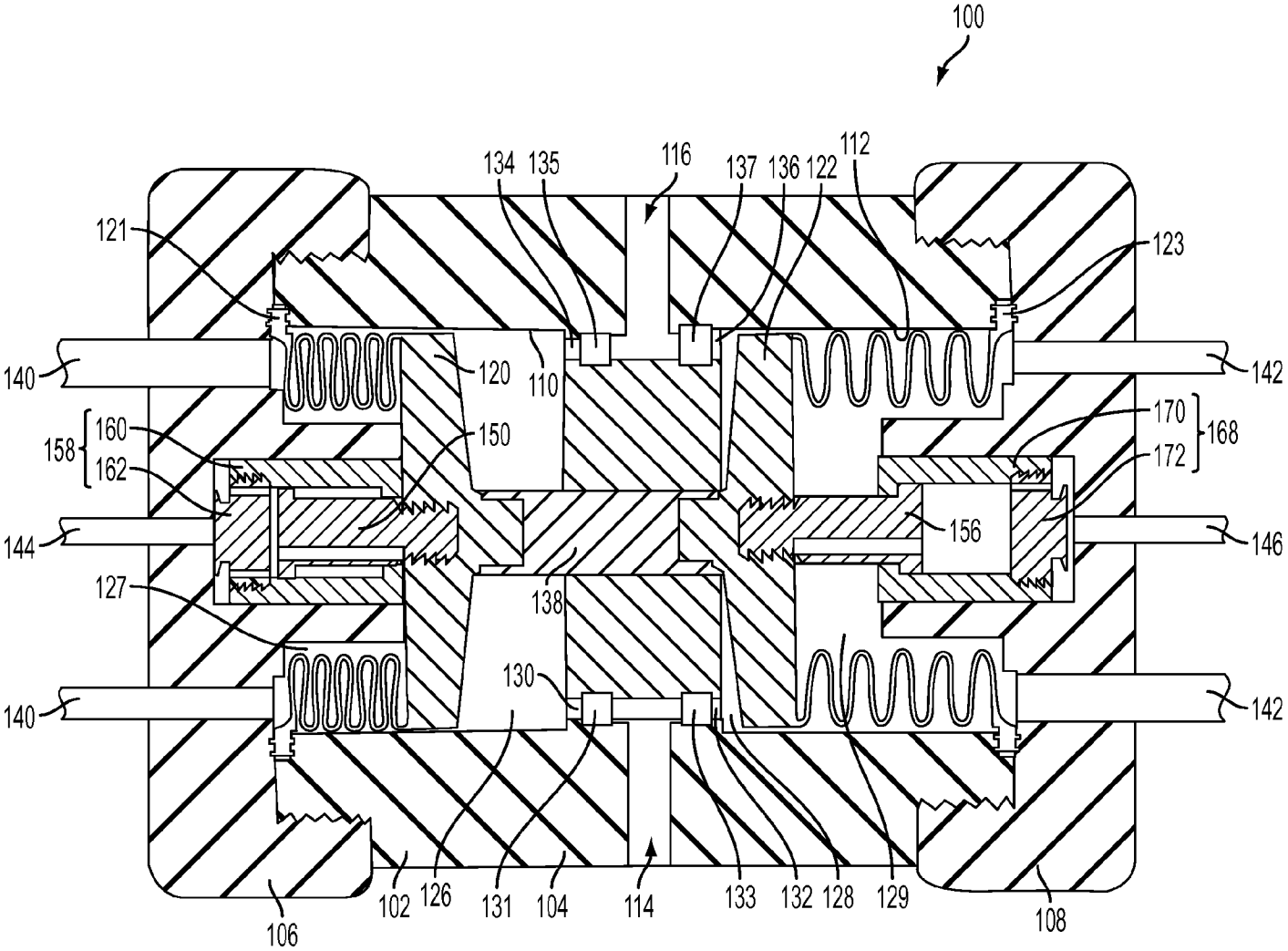
FIG. 1 is a schematically illustrated cross-sectional view of a pump according to an embodiment of the present disclosure.

FIG. 1 is a schematically illustrated cross-sectional view of a pump 100 according to an embodiment of the present disclosure. In some embodiments, the pump 100 is configured to pump a subject fluid, such as, for example, a liquid (e.g., water, oil, acid, etc.), gas, or powdered substance, using a pressurized drive fluid such as, for example, compressed gas (e.g., air). Thus, in some embodiments, the pump 100 may comprise a pneumatically operated liquid pump.

A pump body 102 of the pump 100 may include two or more components that may be assembled together to form the pump body 102. For example, the pump body 102 may include a center body 104, a first end piece 106 that may be attached to the center body 104 on a first side thereof, and a second end piece 108 that may be attached to the center body 104 on an opposite, second side thereof. The pump body 102 may, optionally, also include one or more replaceable seats 194 (see FIG. 10), which will be explained in more detail below.

The pump body 102 may include therein a first cavity 110 and a second cavity 112. A first plunger 120 may be disposed within the first cavity 110, and a second plunger 122 may be disposed within the second cavity 112. In some embodiments, the plungers 120, 122 may each be formed of and comprise a flexible polymer material (e.g., an elastomer or a thermoplastic material). As discussed in further detail below, each of the plungers 120, 122 may comprise, for example, a diaphragm or a bellows, such that the plungers 120, 122 may be longitudinally extended and compressed as the pump 100 is cycled (i.e., in the left and right horizontal directions from the perspective of FIG. 1) during operation thereof. The first plunger 120 may divide the first cavity 110 into a first subject fluid chamber 126 on a first side of the first plunger 120 and a first drive fluid chamber 127 on an opposite, second side of the first plunger 120. Similarly, the second plunger 122 may divide the second cavity 112 into a second subject fluid chamber 128 on a first side of the second plunger 122 and a second drive fluid chamber 129 on an opposite, second side of the second plunger 122.

A peripheral edge 121 of the first plunger 120 may be attached to the pump body 102, and a fluid-tight seal may be provided between the pump body 102 and the first plunger 120 to separate the subject fluid in the first subject fluid chamber 126 from the drive fluid in the drive fluid chamber 127. Similarly, a peripheral edge 123 of the second plunger 122 may be attached to the pump body 102, and a fluid-tight seal may be provided between the pump body 102 and the second plunger 122. The pump 100 may include a main subject fluid inlet 114 and a main subject fluid outlet 116. During operation of the pump 100, subject fluid may be drawn into the pump 100 through the main subject fluid inlet 114 and expelled out from the pump 100 through the main subject fluid outlet 116.

A first subject fluid inlet 130 may be provided in the pump body 102 that leads from the main subject fluid inlet 114 into the first subject fluid chamber 126 through the pump body 102, and a first subject fluid outlet 134 may be provided in the pump body 102 that leads out from the first subject fluid chamber 126 to the main subject fluid outlet 116 through the pump body 102. Similarly, a second subject fluid inlet 132 may be provided in the pump body 102 that leads from the main subject fluid inlet 114 into the second subject fluid chamber 128 through the pump body 102, and a second subject fluid outlet 136 may be provided in the pump body 102 that leads out from the second subject fluid chamber 128 to the main subject fluid outlet 116 through the pump body 102.

A first inlet check valve 131 may be provided proximate the first subject fluid inlet 130 to ensure that fluid is capable of flowing into the first subject fluid chamber 126 through the first subject fluid inlet 130, but incapable of or restricted from flowing out from the first subject fluid chamber 126 through the first subject fluid inlet 130. A first outlet check valve 135 may be provided proximate the first subject fluid outlet 134 to ensure that fluid is capable of flowing out from the first subject fluid chamber 126 through the first subject fluid outlet 134, but incapable of or restricted from flowing into the first subject fluid chamber 126 through the first subject fluid outlet 134. Similarly, a second inlet check valve 133 may be provided proximate the second subject fluid inlet 132 to ensure that fluid is capable of flowing into the second subject fluid chamber 128 through the second subject fluid inlet 132, but incapable of or restricted from flowing out from the second subject fluid chamber 128 through the second subject fluid inlet 132. A second outlet check valve 137 may be provided proximate the second subject fluid outlet 136 to ensure that fluid is capable of flowing out from the second subject fluid chamber 128 through the second subject fluid outlet 136, but incapable of, or restricted from, flowing into the second subject fluid chamber 128 through the second subject fluid outlet 136.

The subject fluid inlets 130, 132 respectively leading to the first subject fluid chamber 126 and the second subject fluid chamber 128 may be in fluid communication with the main subject fluid inlet 114, and the subject fluid outlets 134, 136 respectively leading out from the first subject fluid chamber 126 and the second subject fluid chamber 128 may be in fluid communication with the main subject fluid outlet 116, such that subject fluid may be drawn into the pump 100 through the main subject fluid inlet 114 from a single fluid source, and subject fluid may be expelled from the pump 100 through the main subject fluid outlet 116.

In the configuration described above, the first plunger 120 may be capable of extending in the rightward direction and compressing in the leftward direction from the perspective of FIG. 1. Similarly, the second plunger 122 may be capable of extending in the leftward direction and compressing in the rightward direction from the perspective of FIG. 1. The first plunger 120 and the second plunger 122 may be rigidly coupled to a connecting rod 138 such that the first plunger 120 extends as the second plunger 122 compresses, and the first plunger 120 compresses as the second plunger 122 extends. The connecting rod 138 may extend through a portion of the pump body 102. A fluid-tight seal may be provided between the connecting rod 138 and the pump body 102 with, for example, one or more O-rings (not shown), to keep subject fluid from communicating between the first and second subject fluid chambers 126, 128 through the pump body 102 around the connecting rod 138.

As the first plunger 120 extends and the second plunger 122 compresses, the volume of the first drive fluid chamber 127 increases, the volume of the first subject fluid chamber 126 decreases, the volume of the second subject fluid chamber 128 increases, and the volume of the second drive fluid chamber 129 decreases. As a result, subject fluid may be expelled from the first subject fluid chamber 126 through the first subject fluid outlet 134, and subject fluid may be drawn into the second subject fluid chamber 128 through the second subject fluid inlet 132. The first plunger 120 may be extended and the second plunger 122 may be compressed by providing pressurized drive fluid within the first drive fluid chamber 127 through one or more first drive fluid lines 140, as will be explained in more detail below. By way of example and not limitation, two first drive fluid lines 140 are shown in FIG. 1. A first shift conduit 144 may also be in fluid communication with the first drive fluid chamber 127 at least during a portion of a cycle of the pump 100, such as when the first plunger 120 is fully extended to the right, when viewed in the perspective of FIG. 1, as will be explained in more detail below.

Conversely, as the second plunger 122 extends and the first plunger 120 compresses, the volume of the second drive fluid chamber 129 increases, the volume of the second subject fluid chamber 128 decreases, the volume of the first subject fluid chamber 126 increases, and the volume of the first drive fluid chamber 127 decreases. As a result, subject fluid may be expelled from the second subject fluid chamber 128 through the second subject fluid outlet 136, and subject fluid may be drawn into the first subject fluid chamber 126 through the first subject fluid inlet 130. The second plunger 122 may be extended and the first plunger 120 may be compressed by providing pressurized drive fluid within the second drive fluid chamber 129 through one or more second drive fluid lines 142, as will be explained in more detail below. By way of example and not limitation, two second drive fluid lines 142 are shown in FIG. 1. A second shift conduit 146 may also be in fluid communication with the second drive fluid chamber 129 at least during a portion of a cycle of the pump 100, such as when the second plunger 122 is fully extended to the left, when viewed in the perspective of FIG. 1.

In some embodiments, the pump body 102 and other components of the pump 100 may be at least substantially comprised of at least one polymer material. By way of example and not limitation, such a polymer material may comprise one or more of a fluoropolymer, neoprene, buna-N, ethylene diene M-class (EPDM), VITON®, polyurethane, HYTREL®, SANTOPRENE®, fluorinated ethylene-propylene (FEP), perfluoroalkoxy (PFA) fluorocarbon resin, ethylene-chlorotrifluoroethylene copolymer (ECTFE), ethylene-tetrafluoroethylene copolymer (ETFE), nylon, polyethylene, polyvinylidene fluoride (PVDF), NORDEL™, polytetrafluorethylene (PTFE), chlorotrifluoroethylene (CTFE), and nitrile.

As noted above, the first drive fluid chamber 127 may be pressurized with drive fluid supplied through one or more of the first drive fluid lines 140 during operation of the pump 100. The pressurized drive fluid may push the first plunger 120 to the right (from the perspective of FIG. 1). As the first plunger 120 moves to the right, the second drive fluid chamber 129 may be depressurized and the second plunger 122 may be pushed to the right by the first plunger 120 through the connecting rod 138. The second drive fluid chamber 129 may be depressurized by venting to ambient or by providing a reduced pressure therein through at least one of the second drive fluid lines 142 and the second shift conduit 146. As the first plunger 120 and the second plunger 122 move to the right (from the perspective of FIG. 1), any subject fluid within the first subject fluid chamber 126 may be expelled from the first subject fluid chamber 126 through the first subject fluid outlet 134, and subject fluid will be drawn into the second subject fluid chamber 128 through the second subject fluid inlet 132.

As the first plunger 120 approaches its fully-extended position (i.e., to the right when viewed in the perspective of FIG. 1), the operation just described may be reversed. For example, the second drive fluid chamber 129 may be pressurized with pressurized drive fluid supplied through one or more of the second drive fluid lines 142, which will push the second plunger 122 to the left (from the perspective of FIG. 1). As the second plunger 122 moves to the left, the first drive fluid chamber 127 may be depressurized (e.g., vented to ambient, subjected to a reduced pressure) and the first plunger 120 may be pushed to the left by the second plunger 122 through the connecting rod 138. Similar to the depressurization of the second drive fluid chamber 129 described above, the first drive fluid chamber 127 may be depressurized through at least one of the first drive fluid lines 140 and the first shift conduit 144. As the first plunger 120 and the second plunger 122 move to the left (from the perspective of FIG. 1), subject fluid within the second subject fluid chamber 128 will be expelled from the second subject fluid chamber 128 through the second subject fluid outlet 136, and subject fluid will be drawn into the first subject fluid chamber 126 through the first subject fluid inlet 130.

Thus, to drive the pumping action of the pump 100, the first drive fluid chamber 127 and the second drive fluid chamber 129 may be pressurized in an alternating or cyclic manner to cause the first plunger 120 and the second plunger 122 to reciprocate back and forth within the pump body 102, as discussed above.

Figure 2:
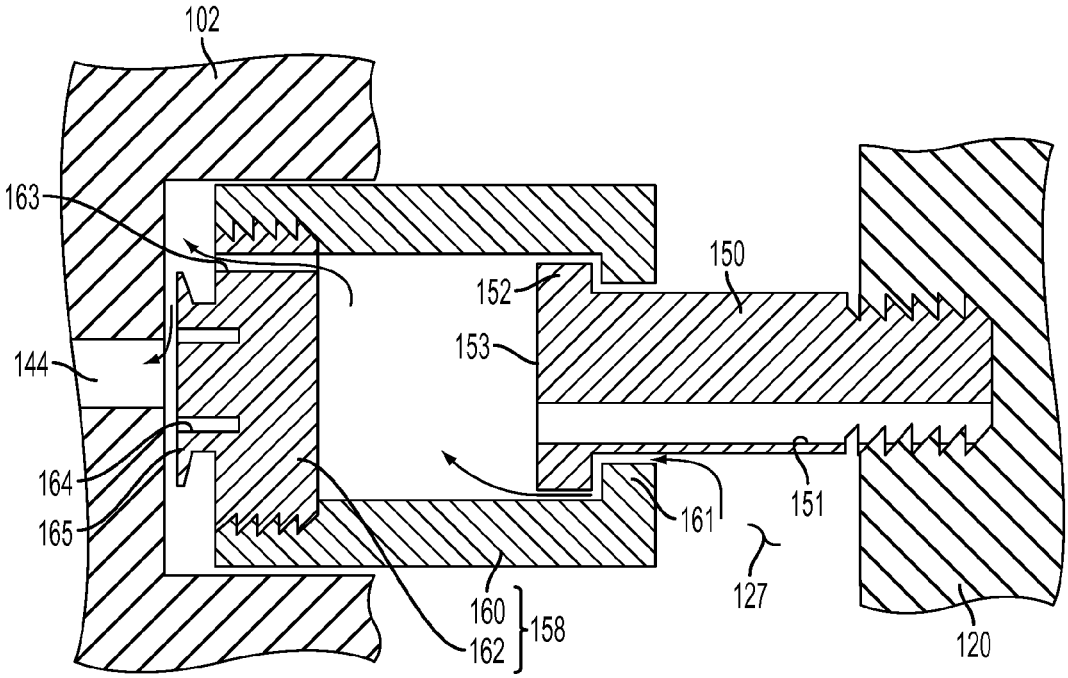
FIG. 2 is an enlarged partial cross-sectional view of components of the pump of FIG. 1 with a first plunger thereof in a fully extended position.

FIG. 2 is an enlarged partial cross-sectional view of components of the pump 100 of FIG. 1 with the first plunger 120 in a fully extended position. Referring to FIG. 1 in conjunction with FIG. 2, the pump 100 may comprise a shifting mechanism for shifting the flow of pressurized drive fluid back and forth between the first drive fluid chamber 127 and the second drive fluid chamber 129. The shifting mechanism may include, for example, one or more shift pistons 150, 152, one or more shift canister assemblies 158, 168, and a shuttle valve (not shown). By way of example and not limitation, a shuttle valve suitable for use with the pump 100 is disclosed in U.S. patent application Ser. No. 12/684,528 (hereinafter "the '528 Application"), titled "BELLOWS PLUNGERS HAVING ONE OR MORE HELICALLY EXTENDING FEATURES, PUMPS INCLUDING SUCH BELLOWS PLUNGERS, AND RELATED METHODS," filed Jan. 8, 2010, the disclosure of which is hereby incorporated herein by this reference.

A first shift canister assembly 158 may include a first shift canister 160 and a first shift canister cap 162. A first shift piston 150 may be coupled to the first plunger 120, such as by threads, an adhesive, a press fit, mechanical interference, etc. By way of example, the first shift piston 150 may be coupled to the first plunger 120 with threads and a longitudinal hole 151 may be formed (e.g., drilled) through at least a portion of the first shift piston 150 and into at least a portion of the first plunger 120. A retaining member (e.g., a pin) (not shown) may be inserted into the longitudinal hole 151 to provide additional mechanical interference and to lock the first shift piston 150 in place relative to the first plunger 120. By way of another example, the first shift piston 150 may be an integral part of the first plunger 120. The first shift piston 150 may comprise an elongated, generally cylindrical body that is oriented generally parallel to an axis along which the first plunger 120 extends and compresses. When the pump 100 is assembled, the first shift piston 150 may be at least partially disposed within the first shift canister 160 to couple (e.g., slidably couple) the first plunger 120 to the first shift canister 160. The first end 153 of the first shift piston 150 may include an integral flange 152 (i.e., an enlarged portion) that is disposed within the first shift canister 160 when assembled therewith. The first shift canister 160 may be generally cylindrical and hollow. One end of the first shift canister 160 may include a lip 161 that extends inwardly. The lip 161 may be integrally formed with (e.g., part of the same body as) sidewalls of the shift canister 160. The flange 152 of the first shift piston 150 may be configured to engage against the lip 161 of the first shift canister 160 as the first plunger 120 approaches a fully extended position, as shown in FIG. 2.

Figure 3:
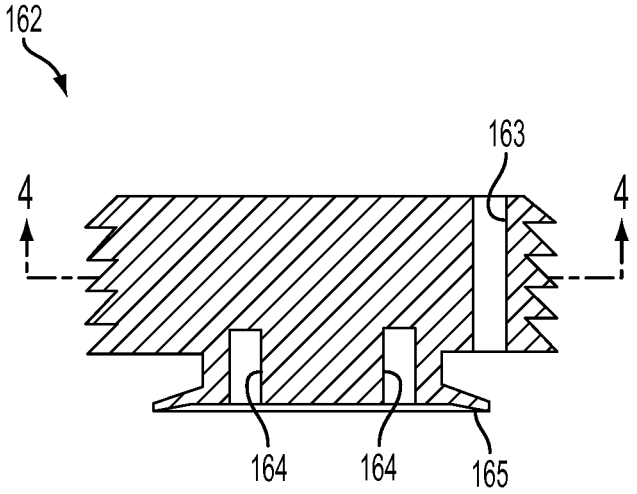
FIG. 3 is a cross-sectional view of a first shift canister cap of the pump of FIG. 1 taken along line 3-3 of FIG. 4 according to an embodiment of the present disclosure.
Figure 4:
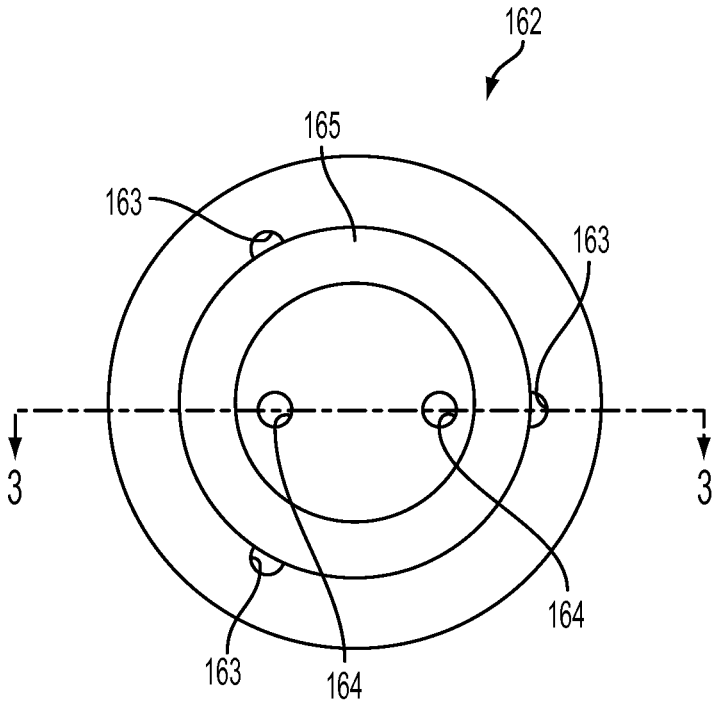
FIG. 4 is a front plan view of the first shift canister cap of the pump of FIG. 1 taken from line 4-4 of FIG. 3.
Figure 5:
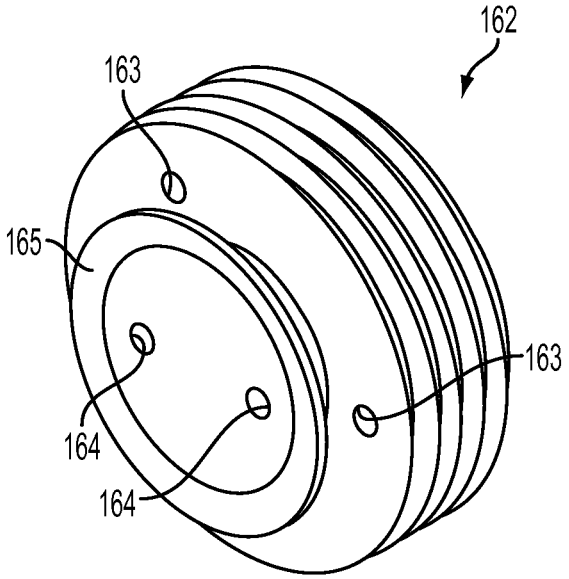
FIG. 5 is a perspective view of the first shift canister cap of the pump of FIG. 1.

FIGS. 3 through 5 illustrate various views of the first shift canister cap 162 of the pump 100 according to an embodiment of the present disclosure. Referring to FIGS. 3 through 5 in conjunction with FIGS. 1 and 2, the first shift canister cap 162 may be attached (e.g., by threads, with an adhesive, by way of a press-fit, by mechanical interference, etc.) to an end of the first shift canister 160 opposite the lip 161 to form the first shift canister assembly 158. The first shift canister cap 162 may include at least one through hole 163 to provide fluid communication from one side of the first shift canister cap 162 to the opposite side thereof (i.e., between the interior and an exterior of the shift canister assembly 158). As shown in FIGS. 4 and 5, in some embodiments, a plurality of through holes 163 may be formed through the first shift canister cap 162. The first shift canister cap 162 may include a sealing surface 165, which is provided for sealing against the pump body 102 and, as a result, inhibiting flow of drive fluid between the first drive fluid chamber 127 and the first shift conduit 144 when sealed. Optionally, the first shift canister cap 162 may include at least one blind hole 164 extending from a sealing side thereof partially into the body of the first shift canister cap 162, which may be useful in assembling the first shift canister cap 162 with the first shift canister 160. For example, in an embodiment where the first shift canister cap 162 is to be attached to the first shift canister 160 via threads, two blind holes 164 may be engaged with corresponding features of a tool used to rotate the first shift canister cap 162 with respect to the first shift canister 160 and engage the threads thereof.

As can be seen in FIG. 1, the pump 100 may also include a second shift piston 156 coupled to the second plunger 122, and a second shift canister assembly 168 including a second shift canister 170 and a second shift canister cap 172. The second shift piston 156 and the second shift canister assembly 168 may be at least substantially the same as the first shift piston 150 and the first shift canister assembly 158, respectively, and are therefore not described separately in detail.

Although not shown in the drawings, a shuttle valve may be operatively connected to the first and second drive fluid lines 140, 142 and to the first and second shift conduits 144, 146 of the pump 100 for alternately shifting flow of pressurized drive fluid between the first and second drive fluid chambers 127, 129. Such shuttle valves are well known in the art of reciprocating pumps and are, therefore, not shown or described in detail in the present disclosure. As noted above, an example shuttle valve that may be suitable for use with the pump of the present disclosure is disclosed in the '528 Application. In general terms, the shuttle valve may include a spool that shifts from a first position to a second position. In the first position, pressurized drive fluid is supplied through the shuttle valve and into the first drive fluid lines 140 and drive fluid is allowed to escape from the second drive fluid chamber 129 through at least one of the second drive fluid lines 142 and the second shift conduit 146. Thus, while the spool of the shuttle valve is in the first position, the pressurized drive fluid forces the first and second plungers 120, 122 to the right, when viewed in the perspective of FIG. 1, as described above. In the second position, pressurized drive fluid is supplied through the shuttle valve and into the second drive fluid lines 142 and drive fluid is allowed to escape from the first drive fluid chamber 127 through at least one of the first drive fluid lines 140 and the second shift conduit 144. Thus, while the spool of the shuttle valve is in the second position, the pressurized drive fluid forces the first and second plungers 120, 122 to the left, when viewed in the perspective of FIG. 1, as described above.

To facilitate a complete understanding of operation of the pump 100 and the associated shift mechanism, a complete pumping cycle of the pump 100 (including a rightward stroke and a leftward stroke of each of the plungers 120, 122) is described below with reference to FIGS. 1 and 2.

A pumping cycle may begin with the internal components of the pump 100 in the position shown in FIGS. 1 and 2. In other words, the first plunger 120 may be fully compressed and the second plunger may be fully extended to the left in the perspectives of FIGS. 1 and 2. As described above, pressurized drive fluid may be introduced into the first drive fluid chamber 127 through the first drive fluid lines 140 to force the first and second plungers 120, 122 to the right.

As the first plunger 120 approaches its fully extended position (i.e., to the right when viewed in the perspective of FIGS. 1 and 2), the flange 152 of the first shift piston 150 may abut against a lip 161 of the first shift canister 160 (see FIG. 2), which forces (pulls) the first shift canister assembly 158 to the right (when viewed in the perspective of FIGS. 1 and 2) to unseal the first shift canister cap 162 from against the pump body 102 and to enable fluid communication between the drive fluid chamber 127 and the first shift conduit 144. As shown by arrows in FIG. 2, drive fluid may flow from the first drive fluid chamber 127 around the flange 152 of the first shift piston 150 to reach the interior of the first shift canister 160. Drive fluid may flow from the interior of the first shift canister 160 through the at least one through hole 163 in the first shift canister end cap 162 into an area proximate the internal opening of the first shift conduit 144. Drive fluid may then enter the first shift conduit 144 and the pressure therein may increase. In some embodiments, and depending on the gaps between the assembled components, drive fluid may also flow toward the first shift conduit 144 by passing around the sidewalls of the first shift canister 160 and/or around the first shift piston 150 and the flange 152. Thus, pressure in the first drive fluid chamber 127 may be introduced into the first shift conduit 144 when the first plunger 120 approaches or is in a fully extended position. Such pressure may force the spool of the shuttle valve to shift from the first position to the second position.

When the spool of the shuttle valve shifts from the first position to the second position, drive fluid may be directed to the second drive fluid lines 142 and the first drive fluid lines 140 may be depressurized by, for example, venting to ambient, being subjected to reduced pressure, etc. As described above, such shifting of drive fluid pressure may cause the first and second plungers 120, 122 to move in the opposite direction (i.e., to the left when viewed in the perspective of FIG. 1) to extend the second plunger 122 and compress the first plunger 120. After the first plunger 120 compresses a short distance, the force of the first shift piston 150 against the first shift canister 160 may be released. Thus, the first shift canister assembly 158 may be free to move back into a position in which the first shift canister cap 162 abuts against the pump body 102 to form a seal around the interior opening of the first shift conduit 144 responsive to, for example, pressurized drive fluid being introduced into the first drive fluid chamber 127.

As shown in FIG. 1, as the second plunger 122 approaches a fully extended position, the second shift piston 156 engages with the second shift canister 170 and forces (pulls) the second shift canister assembly 168 to the left to unseal the second shift canister cap 172 from against the pump body 102. The second shift conduit 146 may, as a result, be exposed to pressure from the second drive fluid chamber 129 in a similar manner to that described above with reference to the first shift conduit 144. The spool of the shuttle valve may be shifted back into the first position responsive to the pressure in the second shift conduit 146. After the spool of the shuttle valve shifts back into the first position, pressurized drive fluid may again be introduced into the first drive fluid chamber 127 and the second drive fluid lines 142 may be depressurized to depressurize the second drive fluid chamber 129. At this point, the pump 100 is back in the position shown in FIGS. 1 and 2, which completes one full cycle of the pump 100. This reciprocating action may be repeated, which may result in at least substantially continuous flow of subject fluid through the pump 100, as described above.

Figure 6:
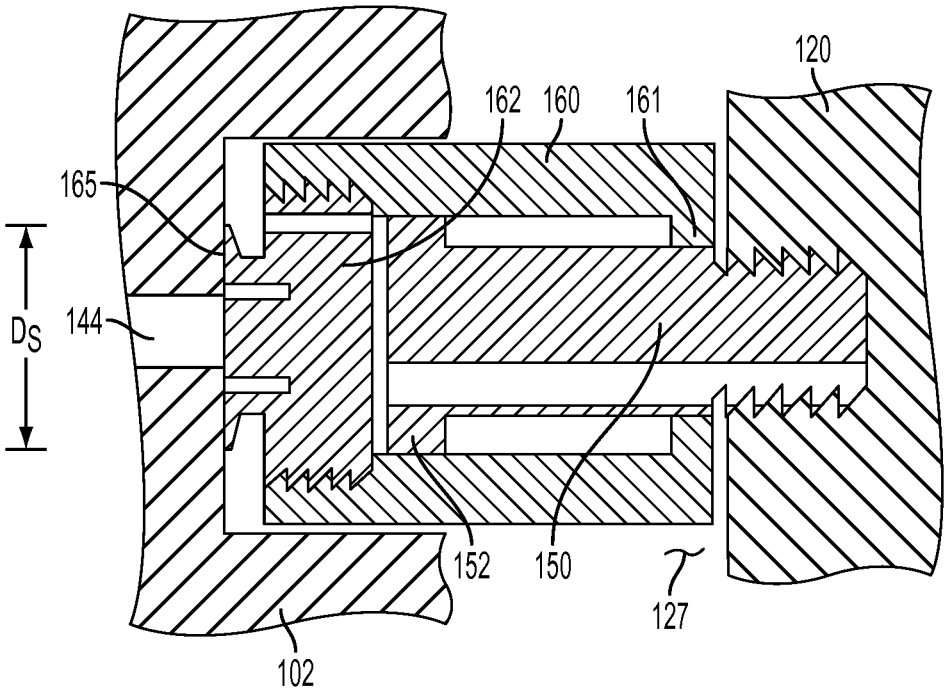
FIG. 6 is an enlarged partial cross-sectional view of components of the pump of FIG. 1, similar to FIG. 2, but with the first plunger thereof in a fully compressed position.

FIG. 6 is an enlarged partial cross-sectional view of components of the pump 100 of FIG. 1, similar to FIG. 2, but with the first plunger 120 in a fully compressed position. Referring to FIG. 1 in conjunction with FIG. 6, when pressurized drive fluid is introduced into the first drive fluid chamber 127 due to the shifting of the shuttle valve, the pressurized drive fluid may press against the first shift canister assembly 158 with a force proportional to an area sealed by the sealing surface 165 of the first shift canister end cap 162. The force with which the drive fluid presses against the first shift canister assembly 158, is expressed by the following equation (1):

$$F=P\times A \tag{1}$$

where F is the force exerted by the pressurized drive fluid, P is the pressure of the drive fluid, and A is an area encompassed by a periphery of an area of contact between the sealing surface 165 and the pump body 102 when a seal is formed during operation of the pump 100. The area A is also referred to herein as the "seal area A." Thus, the force F required to overcome the seal between the sealing surface 165 and the pump body 102 when shifting (also referred to herein as the "shifting force F") at a given pressure P is proportional to the seal area A.

In some embodiments, the shifting force F may be reduced by reducing the seal area A compared to previously known shift canisters. Previously known seal areas may be a relatively high fraction of an outer cross-sectional area of a corresponding shift canister, e.g., more than about 77% of an area encompassed by a periphery of a cross-section of a corresponding shift canister taken in a plane at least substantially perpendicular to an intended direction of movement of the shift canister during operation. However, the seal area A between the sealing surface 165 and the pump body 102 of the present disclosure may be a relatively lower fraction of an outer cross-sectional area of the shift canister 160. By way of example and not limitation, the seal area A of the present disclosure may be less than about 75% of the outer cross-sectional area of the shift canister 160 taken in a plane at least substantially perpendicular to an intended direction of movement of the shift canister assembly during operation. In some embodiments, the seal area A may be less than about 50% of the outer cross-sectional area of the shift canister 160, for example. In one embodiment, the seal area A may be less than about 40% of the outer cross-sectional area of the shift canister 160, for example.

In embodiments including an at least substantially circular sealing surface 165, such as those embodiments shown in the drawings of the present disclosure, the seal area A may be expressed as a function of a shift seal diameter $D_S$, according to the following equation (2):

$$A=\pi\times(D_S)^2/4 \quad (2)$$

Combining these two equations (1) and (2), the force F may be expressed as a function of the pressure P and the shift seal diameter $D_S$ in the following equation (3):

$$F=P\times\pi\times(D_S)^2/4 \quad (3)$$

Thus, in embodiments including a substantially circular sealing surface 165, the shifting force F at a given pressure P is proportional to the square of the shift seal diameter $D_S$.

In some embodiments, the shift seal diameter $D_S$ of the present disclosure may be reduced when compared to previously known seal diameters to reduce the force required to overcome the shift seal at a given drive fluid pressure. For example, previously known sealing surfaces are nearly equal in diameter to an associated shift canister, e.g., more than about 85% of the outer diameter of the associated shift canister. However, the shift seal diameter $D_S$ of the present disclosure may be less than an outer diameter of the first shift canister 160. By way of example and not limitation, the shift seal diameter $D_S$ may be less than about 85% of the outer diameter of the first shift canister 160. In some embodiments, the shift seal diameter $D_S$ may be less than about 70% of the outer diameter of the shift canister 160. In one embodiment, the shift seal diameter $D_S$ may be less than about 60% of the outer diameter of the shift canister 160. By way of example and not limitation, the shift seal diameter $D_S$ may be less than about 0.8 inch (2.03 cm) when the outer diameter of the shift canister 160 is more than about 0.95 inch (2.41 cm). In a particular embodiment, the shift seal diameter $D_S$ may be about 0.65 inch (1.65 cm) when the outer diameter of the shift canister 160 is about 0.95 inch (2.41 cm), for example. In another embodiment, the shift seal diameter $D_S$ may be about 0.65 inch (1.65 cm) when the outer diameter of the shift canister is about 1.12 inches (2.84 cm)

In some embodiments according to the present disclosure, the shifting force may be less than about 50 lbs (222 N) throughout an operating drive fluid pressure range extending from about 60 psi (414 kPa) to about 100 psi (689 kPa). In some embodiments, the shifting force may be less than about 40 lbs (178 N) throughout the same operating drive fluid pressure range. In yet further embodiments, the shifting force may be less than about 35 lbs (156 N) throughout the same operating drive fluid pressure range.

As briefly discussed above, previously known pumps including shift canisters have limitations at least partially due to the forces required to overcome the shift seals. The reduced shift seal diameter $D_S$ of the present disclosure enables either a reduced force required to unseal the opening of the first shift conduit 144 at a given drive fluid pressure, or enables the pump 100 to be run at a higher drive fluid pressure to increase the pumping speed thereof, or both, without mechanical failure of the components of the pump 100. Thus, at least some of the limitations of previously known pumps are overcome or reduced by the relatively smaller shift seal diameter $D_S$ of the present disclosure.

In addition, as noted above, previously known pumps include a shift canister cap that is located on a side of the shift canister opposite the sealing surface. Therefore, the shift piston presses directly against the shift canister cap proximate the threads thereof during each pumping stroke with the force required to overcome the shift seal, which has been observed to cause deformation, wear, and even failure thereof. In contrast, the first shift canister cap 162 of the present disclosure may be located on a sealing side of the first shift canister assembly 158, and the coupling (e.g., threads) between the first shift canister cap 162 and the first shift canister 160 may be relatively distant from the location where the shifting force is applied. The shifting force may be applied on the lip 161 of the shift canister 160, which may be integral with the sidewalls of the shift canister 160. Such a configuration may provide a stronger body against which the flange 152 of the first shift piston 150 presses when applying the shifting force, which may avoid or reduce the deformation, wear, and failure often observed at or near a corresponding location of force application.

Furthermore, previously known shift canisters include one or more bores longitudinally extending through the sidewall thereof to provide fluid communication between the drive fluid chamber and the end of the shift canister closest to the shift seal. Forming such bores adds to the manufacturing costs of previously known reciprocating pumps. However, the first shift canister cap 162 of the present disclosure includes the at least one through hole 163 instead of bores through the sidewalls of the shift canister, such that the sidewalls of the shift canister may be substantially solid. Forming through holes in a sealing end of the previously known shift canister may have been difficult or impossible due to the shift seal radially extending to approximately the full width of the shift canister, leaving little or no room for a through hole to be formed through a longitudinal end thereof in a manner that does not compromise the seal. Manufacturing the through holes 163 according to the present disclosure may be easier, faster, and, as a result, less expensive than forming the previously known bores through the sidewall of the shift canister. Therefore, the pump 100 according to the present disclosure may reduce the manufacturing costs associated with providing fluid communication between the first drive fluid chamber 127 and the first shift conduit 144, when compared with previously known pumps.

FIGS. 7 through 10 are enlarged partial cross-sectional views of components of a pump including various embodiments of a shift canister cap 162A, 162B, 162C, and 162D according to the present disclosure. For clarity and convenience, the shift piston 150 has been removed from the views of FIGS. 7 through 10, although it is to be understood that the shift piston 150 will be included in a fully assembled pump.

Figure 7:
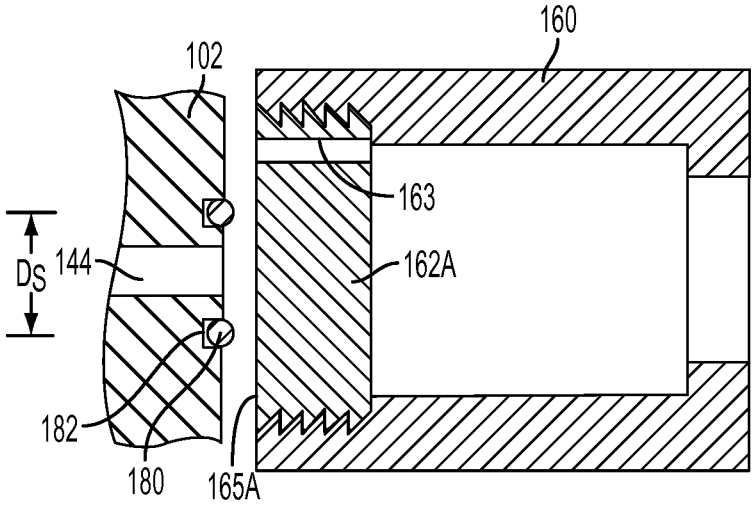
FIG. 7 is an enlarged partial cross-sectional view of components of a pump including a shift canister cap according to an embodiment of the present disclosure.

Referring to FIG. 7, a shift canister cap 162A according to an embodiment of the present disclosure may be similar to the first shift canister cap 162 described above with reference to FIGS. 1 through 6 in that the shift canister cap 162A may be configured to be attached to the first shift canister 160 at a longitudinal end thereof closest to the first shift conduit 144. In addition, at least one through hole 163 may extend through the shift canister cap 162A of FIG. 7 for providing fluid communication between the interior of the first shift canister 160 and a volume proximate the internal opening of the first shift conduit 144. However, the shift canister cap 162A may differ from the first shift canister cap 162 described above in that the shift canister cap 162A may include a sealing surface 165A that is configured to provide a substantially flat area against which an annular seal member 180 (e.g., an O-ring) may seal. In such a configuration, the pump body 102 may include an annular recess 182 formed around the internal opening of the first shift conduit 144 for positioning and receiving at least a portion of the annular seal member 180, as shown in FIG. 7. The sealing surface 165A of the shift canister cap 162A, which may abut against the annular seal member 180 when sealed, may be configured to be substantially flush with a longitudinal end surface of the shift canister 160. In other embodiments (not shown), the shift canister cap 162A may include a protrusion, such that the sealing surface 165A is closer to the pump body 102 than the longitudinal end surface of the shift canister 160. As shown in FIG. 7, the shift seal diameter $D_S$ in this embodiment may correspond to a diameter of the annular seal member 180.

Figure 8:
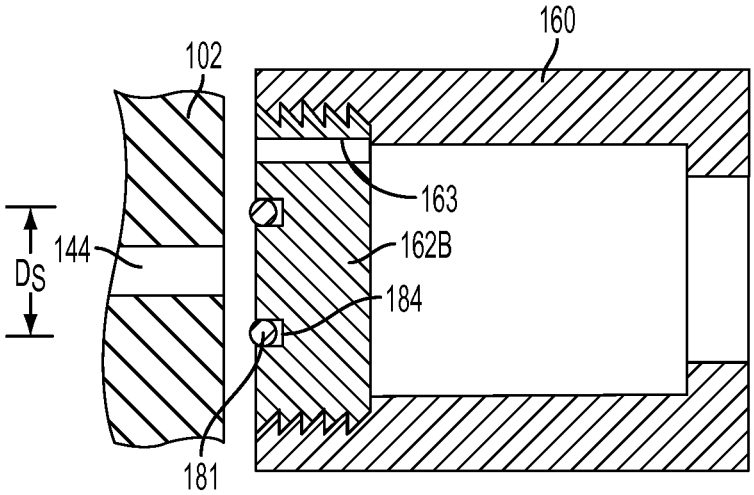
FIG. 8 is an enlarged partial cross-sectional view of components of a pump including a shift canister cap according to another embodiment of the present disclosure.

Referring to FIG. 8, a shift canister cap 162B according to another embodiment of the present disclosure may be similar to the first shift canister cap 162 described above with reference to FIGS. 1 through 6 in that the shift canister cap 162B may be configured to be attached to the first shift canister 160 at a longitudinal end thereof closest to the first shift conduit 144. In addition, at least one through hole 163 may extend through the shift canister cap 162B of FIG. 8 for providing fluid communication between the interior of the first shift canister 160 and a volume proximate the internal opening of the first shift conduit 144. However, the shift canister cap 162B may differ from the first shift canister cap 162 described above in that the shift canister cap 162B may include an annular recess 184 formed in a surface thereof closest to the internal opening of the first shift conduit 144. The annular recess 184 may be configured to position and receive at least a portion of an annular seal member 181. The annular recess 184 may be configured to circumscribe the internal opening of the first shift conduit 144 when the annular seal member 181 positioned therein is sealed against the pump body 102. As shown in FIG. 8, the shift seal diameter $D_S$ in this embodiment corresponds to a diameter of the annular seal member 181.

Figure 9:
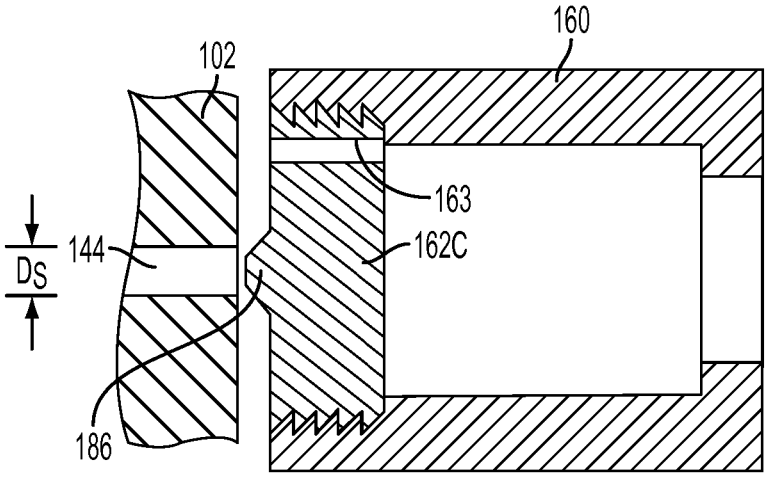
FIG. 9 is an enlarged partial cross-sectional view of components of a pump including a shift canister cap according to another embodiment of the present disclosure.

Referring to FIG. 9, a shift canister cap 162C according to another embodiment of the present disclosure may be similar to the first shift canister cap 162 described above with reference to FIGS. 1 through 6 in that the shift canister cap 162C may be configured to be attached to the first shift canister 160 at a longitudinal end thereof closest to the first shift conduit 144. In addition, at least one through hole 163 may extend through the shift canister cap 162C of FIG. 9 for providing fluid communication between the interior of the first shift canister 160 and a volume proximate the internal opening of the first shift conduit 144. However, the shift canister cap 162C may differ from the first shift canister cap 162 described above in that the shift canister cap 162C may include a protrusion 186 on a sealing side thereof, which may be configured to seal against the internal opening of the first shift conduit 144. The protrusion 186 may be sized and configured to dispose at least a portion thereof within the internal opening of the first shift conduit 144 when sealed. By way of example and not limitation, the protrusion 186 may have a shape that is substantially conical, frustroconical (as shown in FIG. 9), or hemispherical. As shown in FIG. 9, the shift seal diameter $D_S$ in this embodiment may correspond to a diameter of the internal opening of the first shift conduit 144, against which the protrusion 186 may abut when sealed.

Figure 10:
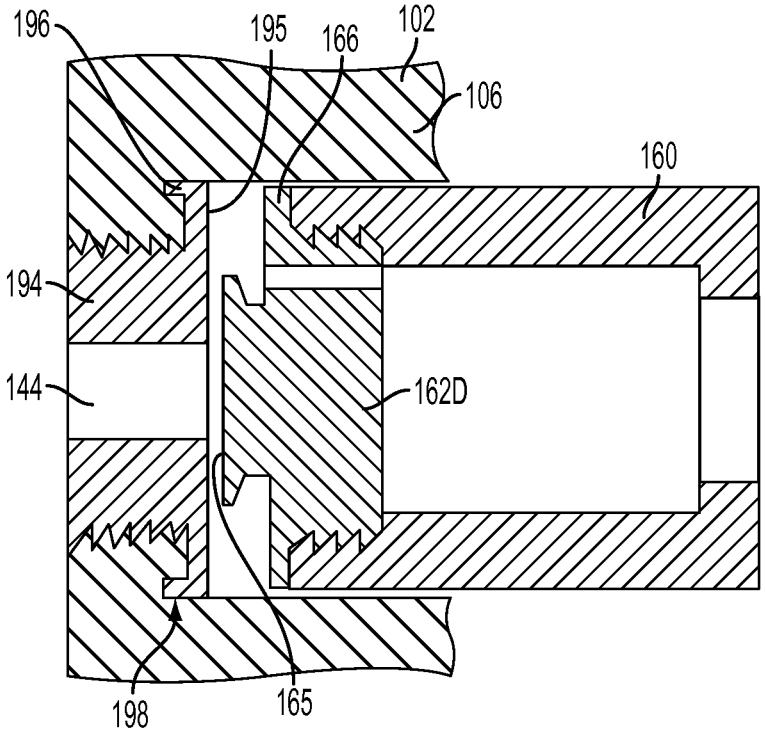
FIG. 10 is an enlarged partial cross-sectional view of components of a pump including a replaceable seat and a shift canister cap according to another embodiment of the present disclosure.

FIG. 10 is an enlarged partial cross-sectional view of components of a pump including a replaceable seat 194 and a shift canister cap 162D according to another embodiment of the present disclosure. The shift canister cap 162D may be substantially similar to any of the shift canister caps 162, 162A, 162B, 162C previously described, except the shift canister cap 162D shown in FIG. 10 may include a substantially annular protrusion 166 that may be configured to abut against a longitudinal end of the first shift canister 160. Thus, during assembly of the shift canister cap 162D with the first shift canister 160, the shift canister cap 162D may be positioned (e.g., screwed, inserted, press-fit, etc.) with respect to the shift canister 160 until the annular protrusion 166 abuts against the longitudinal end of the first shift canister 160. Furthermore, one of ordinary skill in the art will recognize that any of the shift canister caps 162, 162A, 162B, and 162C described above may also include the annular protrusion 166.

Although not shown in the views of FIGS. 7 through 10, any of the shift canister caps 162A, 162B, 162C, and 162D may include one or more blind holes to assist in assembly with the first shift canister 160, similar to the at least one blind hole 164 described above with reference to the first shift canister cap 162. Furthermore, although FIGS. 7 through 10 have been described with reference to various embodiments of a shift canister cap 162A, 162B, 162C, and 162D for coupling to the first shift canister 160, one of ordinary skill in the art will recognize that the shift canister caps 162A, 162B, 162C, and 162D may also be used in place of the second shift canister cap 172 for coupling to the second shift canister 170 (FIG. 1).

Referring again to FIG. 10, the pump body 102 may include at least one replaceable seat 194. Although the replaceable seat 194 is only shown in FIG. 10, it is to be understood that the embodiments of any of FIGS. 1, 2, and 6 through 9 may also be modified to include the replaceable seat 194. The replaceable seat 194 may be attached to the first end piece 106 of the pump body 102 by way of, for example, a threaded connection, mechanical interference, a press-fit, etc. The replaceable seat 194 may comprise at least a portion of the first shift conduit 144. Alternatively, the replaceable seat 194 may comprise a female connection (e.g., female threads, a press-fit opening, etc.) to which the shift conduit 144 may be attached. The replaceable seat 194 may include a seal seat surface 195 against which the sealing surface 165 of the shift canister cap 160D (or of any of the shift canister caps 162, 162A, 162B, 162C, or 172 shown in FIGS. 1 through 9) may form a seal during operation.

Optionally, the replaceable seat 194 may include an annular protrusion 196 to provide additional surface area between the replaceable seat 194 and the first end piece 106 for forming a fluid-tight seal to inhibit movement of drive fluid from within the pump body 102 to an exterior of the pump body 102 around the replaceable seat 194. The first end piece 106 may include a groove that is complementary to the annular protrusion 196, within which the annular protrusion 196 may be at least partially disposed to form a so-called "tongue-in-groove" connection 198. However, in some embodiments, a sufficiently fluid-tight seal may be provided between the replaceable seat 194 and the first end piece 106 without the annular protrusion 196, such that the annular protrusion 196 may be omitted in such embodiments. Furthermore, it will be apparent to one of ordinary skill in the art that, if the annular protrusion 196 is included, the annular protrusion 196 may be positioned on a side of the replaceable seat 194 that is exterior to the reciprocating fluid pump, rather than on an interior side thereof (as shown in FIG. 10).

Although the replaceable seat 194 is shown in FIG. 10 as being generally radially smaller than the internal bore in which the shift canister 160 is disposed, the present disclosure is not so limited. For example, in some embodiments, the replaceable seat 194 may have a diameter that is approximately the same size as the internal bore. In other embodiments, the replaceable seat 194 may have a diameter that is larger than the internal bore. Thus, a variety of configurations of the replaceable seat 194 and the first end piece 106 may be used in embodiments of the present disclosure, as will be appreciated by one of ordinary skill in the art.

Due to the reciprocating action of the pump described above, the sealing surface 165 may engage and disengage with the seal seat surface 195 repeatedly, which may induce wear in the seal seat surface 195. Such wear may cause the seal formed between the sealing surface 165 and the seal seat surface 195 to at least partially fail and, therefore, form a leak through which at least some drive fluid may pass into the first shift conduit 144. If such a leak develops, the efficiency of the pump may be reduced, or the pump may even fail to operate. The replaceable seat 194 may be replaced periodically to prevent such a failure or may be replaced after such a failure to reduce the costs of refurbishing or replacing the pump.

Figure 11:
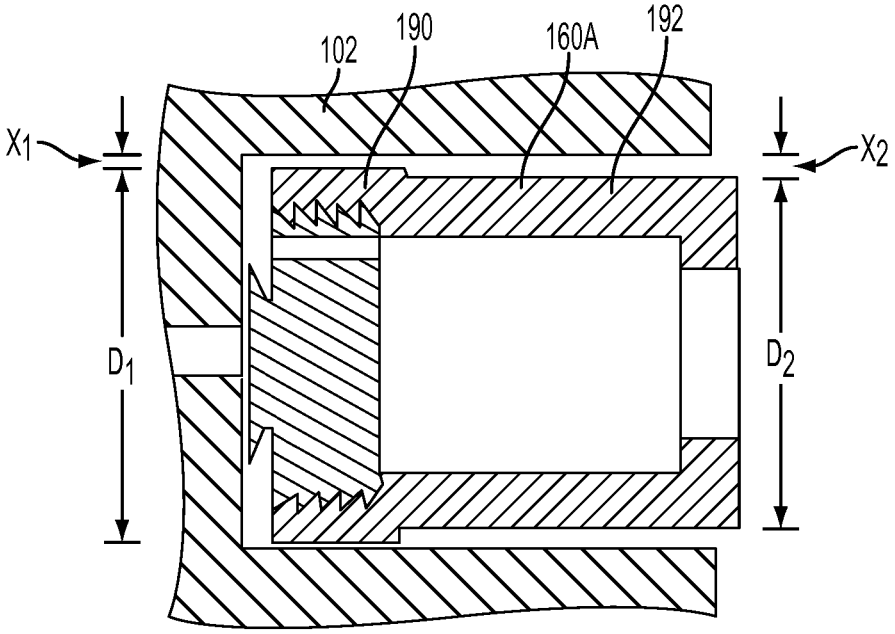
FIG. 11 is an enlarged partial cross-sectional view of components of a pump including a shift canister according to an embodiment of the present disclosure.

FIG. 11 is an enlarged partial cross-sectional view of components of a pump including a shift canister 160A according to another embodiment of the present disclosure, which may be used in place of one or both of the first and second shift canisters 160, 170 of the pump 100 (FIG. 1). For clarity and convenience, the shift piston has been removed from the view of FIG. 10. The shift canister 160A may include a first longitudinal portion 190 that has a first outer circumference and a second longitudinal portion 192 that has a second outer circumference that is less than the first outer circumference. In embodiments including a substantially circular shift canister 160A, such as that shown in FIG. 11, the first longitudinal portion 190 may have a first outer diameter $D_1$ and the second longitudinal portion 192 may have a second outer diameter $D_2$ that is less than the first outer diameter $D_1$. As shown in FIG. 11, the first longitudinal portion 190 is located closer to the first shift conduit 144 than the second longitudinal portion 192. By way of example and not limitation, the difference between the first outer diameter $D_1$ and the second outer diameter $D_2$ may be between about 0.020 inch (0.5 mm) and about 0.040 inch (1.0 mm). As a result of the difference in the first and second outer diameters $D_1$ and $D_2$, a thickness of a first gap $X_1$ between the first longitudinal portion 190 of the shift canister 160A and a surrounding portion of the pump body 102 may be smaller than a thickness of a second gap $X_2$ between the second longitudinal portion 192 of the shift canister 160A and a surrounding portion of the pump body 102. In one embodiment, the thickness of the first gap $X_1$ may be about 0.007 inch (0.18 mm) and the thickness of the second gap $X_2$ may be about 0.017 inch (0.43 mm), for example Although the transition between the first longitudinal portion 190 and the second longitudinal portion 192 of the shift canister 160A is shown in FIG. 11 as a stepped transition, the present disclosure is not so limited. For example, the transition between the first and second longitudinal portions 190, 192 may be at least one of single stepped, multi stepped, curved, and tapered. Furthermore, the shift canister 160A may be used with any of the shift canister caps 162, 162A, 162B, 162C, 162D, or 172 described above.

The configuration of the shift canister 160A may reduce friction and wear between the shift canister 160A and the surrounding pump body 102 by providing a bigger gap between the second longitudinal portion 192 of the shift canister 160A and the pump body 102, when compared to embodiments having a shift canister with a generally uniform outer diameter. The relatively bigger second gap $X_2$ may enable the shift canister 160A to move longitudinally (i.e., to the left and right when viewed in the perspective of FIG. 10) with a reduced likelihood of rubbing against the surrounding pump body 102 along at least a portion of the second longitudinal portion 192.

Figure 12:
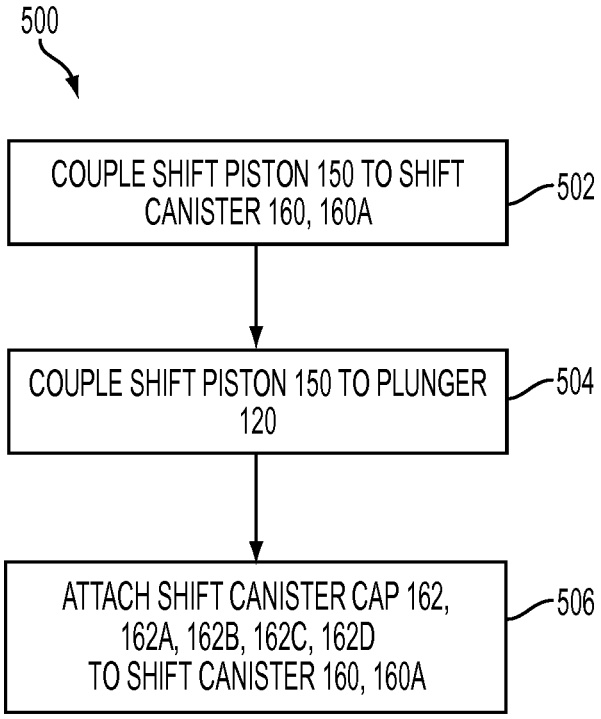
FIG. 12 is a flow chart showing a method for forming a pump, such as the pump of FIG. 1, according to an embodiment of the present disclosure.

The present disclosure includes methods of forming a pump. FIG. 12 is a flow chart showing a method 500 for forming a pump, such as the pump 100 of FIG. 1, according to an embodiment of the present disclosure. An operation 502 of the method 500 includes coupling (e.g., slidably coupling) a shift piston 150 to a shift canister 160, 160A. For example, an enlarged end the shift piston 150 may be disposed within the shift canister 160, 160A and another end of the shift piston 150 opposite the enlarged end thereof may be passed through a longitudinal end of the shift canister 160, 160A. As shown at operation 504, the another end of the shift piston 150 may be coupled to a plunger 120, such as by at least one of threads, mechanical interference, an adhesive, a press fit, etc. At operation 506, a shift canister cap 162, 162A, 162B, 162C, 162D may be attached to the shift canister 160, 160A, such as by at least one of threads, mechanical interference, an adhesive, a press fit, etc. The shift canister cap 162, 162A, 162B, 162C, 162D may be attached at an end of the shift canister 160, 160A opposite the longitudinal end through which the another end of the shift piston 150 is passed. The shift canister cap 162, 162A, 162B, 162C, 162D may include a sealing surface.

In some embodiments, the method 500 may include another operation (not shown) wherein the shift piston 150, the shift canister 160, 160A, the shift canister cap 162, 162A, 162B, 162C, 160D, and the plunger 120 may be disposed within a cavity of a pump body. For example, the plunger 120 may be disposed within the cavity to define a subject fluid chamber on one side of the plunger 120 and to define a drive fluid chamber on another, opposite side of the plunger 120. The shift piston 150, the shift canister 160, 160A, and the canister cap 162, 162A, 162B, 162C, 162D may be disposed at least partially within the drive fluid chamber.

In some embodiments, the method 500 may include another operation (not shown) wherein the shift canister 160, 160A and the shift canister cap 162, 162A, 162B, 162C, 162D are formed. For example, the shift canister 160, 160A may be formed to have substantially solid sidewalls that lack a longitudinal bore therethrough and the shift canister cap 162, 162A, 162B, 162C, 162D may be formed to include at least one through hole. The at least one through hole may extend from a side of the shift canister cap 162, 162A, 162B, 162C, 162D comprising the sealing surface to another, opposite side of the shift canister cap 162, 162A, 162B, 162C, 162D. The method 500 of forming the pump may also include other operations that will be apparent to one of ordinary skill in the art upon consideration of the present disclosure as a whole.

Additional non-limiting example embodiments are set forth below:

Embodiment 1: A reciprocating pump for pumping a subject fluid, the reciprocating pump comprising: a pump body including at least one cavity therein; at least one plunger located at least partially within the at least one cavity of the pump body, the at least one plunger configured to expand and compress in a reciprocating action to pump subject fluid through at least one subject fluid chamber within the at least one cavity during operation of the reciprocating pump; and at least one shift canister assembly disposed within the at least one cavity, the at least one shift canister assembly including a sealing surface configured to contact the pump body to form a seal between the sealing surface and the pump body during operation of the reciprocating pump, wherein an area encompassed by a periphery of an area of contact between the sealing surface and the pump body, when sealed during operation of the reciprocating pump, is less than about 75% of an area encompassed by a periphery of a cross-section of the shift canister assembly taken in a plane at least substantially perpendicular to an intended direction of movement of the shift canister assembly during operation.

Embodiment 2: The reciprocating pump of Embodiment 1, wherein the at least one shift canister assembly is at least substantially circular in outer cross-section and the sealing surface is at least substantially circular.

Embodiment 3: The reciprocating pump of any of Embodiments 1 and 2, wherein the sealing surface comprises a substantially circular sealing surface having a diameter of less than about 0.8 inch (2.03 cm).

Embodiment 4: The reciprocating pump of any of Embodiments 1 through 3, further comprising at least one drive fluid chamber within the at least one cavity of the pump body, the at least one plunger separating the at least one drive fluid chamber from the at least one subject fluid chamber within the at least one cavity.

Embodiment 5: The reciprocating pump of Embodiment 4, further comprising a shift conduit extending at least between an exterior of the pump body and the at least one drive fluid chamber, the shift conduit for shifting a direction of movement of the at least one plunger when the shift conduit receives pressurized drive fluid from within the at least one drive fluid chamber.

Embodiment 6: The reciprocating pump of Embodiment 5, wherein the sealing surface is configured to contact the pump body to form a seal around an opening of the shift conduit to inhibit flow of drive fluid between the drive fluid chamber and the at least one shift conduit during a portion of a cycle of the reciprocating pump.

Embodiment 7: The reciprocating pump of any of Embodiments 1 through 6, wherein the at least one shift canister assembly including the sealing surface comprises a shift canister cap and a shift canister.

Embodiment 8: The reciprocating pump of Embodiment 7, wherein the shift canister cap comprises the sealing surface of the at least one shift canister assembly.

Embodiment 9: The reciprocating pump of any of Embodiments 7 and 8, wherein the shift canister cap is attached to the shift canister by at least one of threads, adhesive, a press-fit, and mechanical interference.

Embodiment 10: The reciprocating pump of any of Embodiments 7 through 9, wherein the shift canister cap comprises at least one through hole extending across a thickness thereof located to provide fluid communication between an interior of the shift canister assembly and an exterior of the shift canister assembly.

Embodiment 11: The reciprocating pump of any of Embodiments 1 through 10, further comprising an annular seal member positioned at least partially in an annular recess formed in one of the pump body and the sealing surface of the at least one shift canister assembly.

Embodiment 12: The reciprocating pump of any of Embodiments 1 through 11, wherein the shift canister assembly comprises a protrusion comprising the sealing surface, the protrusion having a shape that is conical, frustroconical, or hemispherical.

Embodiment 13: The reciprocating pump of any of Embodiments 1 through 12, wherein the shift canister assembly comprises a first longitudinal portion having a first outer diameter and a second longitudinal portion having a second outer diameter that is less than the first outer diameter.

Embodiment 14: The reciprocating pump of any of Embodiments 1 through 13, wherein a portion of the pump body with which the sealing surface of the at least one shift canister assembly is configured to form the seal during operation of the reciprocating pump comprises a replaceable seat.

Embodiment 15: The reciprocating pump of any of Embodiments 1 through 14, wherein the area encompassed by the periphery of the area of contact between the sealing surface and the pump body, when sealed during operation of the reciprocating pump, is less than about 50% of the area encompassed by the periphery of the cross-section of the shift canister assembly taken in the plane at least substantially perpendicular to the intended direction of movement of the shift canister assembly during operation.

Embodiment 16: A reciprocating pump for pumping a subject fluid, the reciprocating pump comprising: a pump body; a shift conduit extending at least between an exterior of the pump body and a drive fluid chamber within the pump body; and a shift canister assembly within the drive fluid chamber configured to form a seal to isolate the shift conduit from the drive fluid chamber for a portion of an operating cycle of the reciprocating pump, wherein a shifting force required to overcome the seal is less than about 50 lbs (222 N) throughout an operating drive fluid pressure range extending from about 60 psi (414 kPa) to about 100 psi (689 kPa).

Embodiment 17: The reciprocating pump of Embodiment 16, wherein the shifting force is less than about 40 lbs (178 N) throughout the operating drive fluid pressure range extending from about 60 psi (414 kPa) to about 100 psi (689 kPa).

Embodiment 18: The reciprocating pump of any of Embodiments 16 and 17, wherein the shifting force is less than about 35 lbs (156 N) throughout the operating drive fluid pressure range extending from about 60 psi (414 kPa) to about 100 psi (689 kPa).

Embodiment 19: The reciprocating pump of any of Embodiments 7 through 10 and 16 through 18, wherein the pump body and the shift canister are each at least substantially comprised of at least one polymer material.

Embodiment 20: The reciprocating pump of any of Embodiments 16 through 19, further comprising a replaceable seat attached to the pump body against which the shift canister assembly is configured to form a seal.

Embodiment 21: The reciprocating pump of Embodiment 20, wherein the replaceable seat comprises an annular protrusion to provide additional surface area between the replaceable seat and the pump body for forming a fluid-tight seal therebetween.

Embodiment 22: The reciprocating pump of Embodiment 21, wherein the annular protrusion is positioned on a side of the replaceable seat that is interior to the reciprocating fluid pump.

Embodiment 23: A reciprocating fluid pump, comprising: a shift canister; a shift piston at least partially disposed within the shift canister; and a shift canister cap attached to the shift canister on a longitudinal end of the shift canister opposite the shift piston.

Embodiment 24: The reciprocating fluid pump of Embodiment 23, wherein the shift canister cap includes a sealing surface for providing a fluid-tight seal against a pump body of the reciprocating fluid pump.

Embodiment 25: The reciprocating fluid pump of any of Embodiments 23 and 24, wherein the shift piston comprises an elongated body with an enlarged end, the enlarged end disposed within the shift canister.

Embodiment 26: The reciprocating fluid pump of Embodiment 25, wherein the shift canister comprises a lip extending inwardly and configured to engage against the enlarged end of the shift piston during at least a portion of operation of the reciprocating fluid pump.

Embodiment 27: The reciprocating fluid pump of Embodiment 26, wherein the lip is integrally formed with sidewalls of the shift canister.

Embodiment 28: The reciprocating fluid pump of any of Embodiments 23 through 27, wherein the shift piston includes a through hole configured to provide fluid communication between a chamber of the reciprocating fluid pump and an interior of the shift canister.

Embodiment 29: A reciprocating fluid pump, comprising: a pump body; a drive fluid chamber within the pump body; and a shift canister assembly within the drive fluid chamber for shifting flow of drive fluid during operation of the reciprocating fluid pump, the shift canister assembly comprising a first longitudinal portion that has a first outer circumference and a second longitudinal portion that has a second outer circumference that is less than the first outer circumference.

Embodiment 30: The reciprocating fluid pump of Embodiment 29, wherein the shift canister assembly comprises a shift canister comprising the first longitudinal portion and the second longitudinal portion and a shift canister cap attached to the shift canister at a sealing end thereof.

Embodiment 31: The reciprocating fluid pump of any of Embodiments 29 and 30, wherein the first longitudinal portion has a first outer diameter and the second longitudinal portion has a second diameter less than the first outer diameter, and a difference between the first outer diameter and the second outer diameter is between about 0.020 inch (0.5 mm) and about 0.040 inch (1.0 mm).

Embodiment 32: A method for forming a reciprocating fluid pump, comprising: disposing an enlarged end of a shift piston within a shift canister and passing another end of the shift piston opposite the enlarged end through a longitudinal end of the shift canister to couple the shift piston to the shift canister; coupling the another end of the shift piston opposite the enlarged end to a plunger; and attaching a shift canister cap to another longitudinal end of the shift canister opposite the longitudinal end through which the another end of the shift piston is passed, the shift canister cap comprising a sealing surface.

Embodiment 33:The method of Embodiment 32, further comprising disposing the shift piston, shift canister, shift canister cap, and plunger within a cavity of a pump body.

Embodiment 34: The method of any of Embodiments 32 and 33, further comprising: forming the shift canister to have substantially solid sidewalls lacking a longitudinal bore therethrough; and forming the shift canister cap to include at least one through hole extending from a side of the shift canister cap comprising the sealing surface to another, opposite side of the shift canister cap.

Embodiment 35: A method for forming a reciprocating fluid pump, the method comprising forming a reciprocating fluid pump according to any of Embodiments 1 through 31.

While certain embodiments have been described and shown in the accompanying drawings, such embodiments are merely illustrative and not restrictive of the scope of the present disclosure. The present disclosure is not limited to the specific constructions and arrangements shown and described, since various other additions and modifications to, and deletions from, the described embodiments will be apparent to one of ordinary skill in the art. For example, elements or features described in relation to one embodiment may be implemented into other embodiments without departing from the scope of the present disclosure. The scope of the invention is only limited by the following claims and their legal equivalents.

What is claimed is:

1. A reciprocating pump for pumping a subject fluid, the reciprocating pump comprising: a pump body including at least one cavity therein;

at least one plunger located at least partially within the at least one cavity of the pump body, the at least one plunger configured to expand and compress in a reciprocating action to pump subject fluid through at least one subject fluid chamber within the at least one cavity during operation of the reciprocating pump; and at least one shift canister assembly disposed within the at least one cavity, the at least one shift canister assembly including a sealing surface configured to contact the pump body to form a seal between the sealing surface and the pump body during operation of the reciprocating pump, wherein an area encompassed by a periphery of an area of contact between the sealing surface and the pump body, when sealed during operation of the reciprocating pump, is less than about 75% of an area encompassed by a periphery of a cross-section of the at least one shift canister assembly taken in a plane at least substantially perpendicular to an intended direction of movement of the at least one shift canister assembly during operation, wherein the at least one shift canister assembly comprises a shift canister cap and a shift canister, wherein the shift canister cap comprises at least one through hole extending across a thickness thereof located to provide fluid communication between an interior of the at least one shift canister assembly and an exterior of the at least one shift canister assembly.

2. The reciprocating pump of claim 1, wherein the at least one shift canister assembly is at least substantially circular in outer cross-section and the sealing surface is at least substantially circular.

3. The reciprocating pump of claim 1, wherein the sealing surface comprises a substantially circular sealing surface having a diameter of less than about 0.8 inch (2.03 cm).

4. The reciprocating pump of claim 1, further comprising at least one drive fluid chamber within the at least one cavity of the pump body, the at least one plunger separating the at least one drive fluid chamber from the at least one subject fluid chamber within the at least one cavity.

5. The reciprocating pump of claim 4, further comprising a shift conduit extending at least between an exterior of the pump body and the at least one drive fluid chamber, the shift conduit for shifting a direction of movement of the at least one plunger when the shift conduit receives pressurized drive fluid from within the at least one drive fluid chamber.

6. The reciprocating pump of claim 5, wherein the sealing surface is configured to contact the pump body to form a seal around an opening of the shift conduit to inhibit flow of drive fluid between the drive fluid chamber and the at least one shift conduit during a portion of a cycle of the reciprocating pump.

7. The reciprocating pump of claim 1, wherein the shift canister cap comprises the sealing surface of the at least one shift canister assembly.

8. The reciprocating pump of claim 1, wherein the shift canister cap is attached to the shift canister by at least one of threads, adhesive, a press-fit, and mechanical interference.

9. The reciprocating pump of claim 1, further comprising an annular seal member positioned at least partially in an annular recess formed in one of the pump body and the sealing surface of the at least one shift canister assembly.

10. The reciprocating pump of claim 1, wherein the at least one shift canister assembly comprises a protrusion comprising the sealing surface, the protrusion having a shape that is conical, frustoconical, or hemispherical.

11. The reciprocating pump of claim 1, wherein the at least one shift canister assembly comprises a first longitudinal portion having a first outer diameter and a second longitudinal portion having a second outer diameter that is less than the first outer diameter.

12. The reciprocating pump of claim 1, wherein a portion of the pump body with which the sealing surface of the at least one shift canister assembly is configured to form the seal during operation of the reciprocating pump comprises a replaceable seat.

13. The reciprocating pump of claim 1, wherein the area encompassed by the periphery of the area of contact between the sealing surface and the pump body, when sealed during operation of the reciprocating pump, is less than about 50% of the area encompassed by the periphery of the cross-section of the at least one shift canister assembly taken in the plane at least substantially perpendicular to the intended direction of movement of the at least one shift canister assembly during operation.

14. A reciprocating pump for pumping a subject fluid, the reciprocating pump comprising: a pump body; a shift conduit extending at least between an exterior of the pump body and a drive fluid chamber within the pump body;

a shift canister assembly within the drive fluid chamber configured to form a seal to isolate the shift conduit from the drive fluid chamber for a portion of an operating cycle of the reciprocating pump, wherein a shifting force required to overcome the seal is less than about 50 lbs (222 N) throughout an operating drive fluid pressure range extending from about 60 psi (414 kPa) to about 100 psi 689 kPa); and a replaceable seat attached to the pump body against which the shift canister assembly is configured to form a seal, the replaceable seat comprising an annular protrusion to provide additional surface area between the replaceable seat and the pump body for forming a fluid-tight seal therebetween.

15. The reciprocating pump of claim 14, wherein the shifting force is less than about 40 lbs (178 N) throughout the operating drive fluid pressure range extending from about 60 psi (414 kPa) to about 100 psi (689 kPa).

16. The reciprocating pump of claim 14, wherein the shifting force is less than about 35 lbs (156 N) throughout the operating drive fluid pressure range extending from about 60 psi (414 kPa) to about 100 psi (689 kPa).

17. The reciprocating pump of claim 14, wherein the pump body and the shift canister are each at least substantially comprised of at least one polymer material.

18. The reciprocating pump of claim 14, wherein the annular protrusion is positioned on a side of the replaceable seat that is interior to the reciprocating fluid pump.

19. A reciprocating fluid pump, comprising:

a shift canister; a shift piston at least partially disposed within the shift canister, the shift piston including a through hole configured to provide fluid communication between a chamber of the reciprocating fluid pump and an interior of the shift canister; and a shift canister cap removably attached to the shift canister on a longitudinal end of the shift canister opposite the shift piston.

20. The reciprocating fluid pump of claim 19, wherein the shift canister cap includes a sealing surface for providing a fluid-tight seal against a pump body of the reciprocating fluid pump.

21. The reciprocating fluid pump of claim 19, wherein the shift piston comprises an elongated body with an enlarged end, the enlarged end disposed within the shift canister.

22. The reciprocating fluid pump of claim 21, wherein the shift canister comprises a lip extending inwardly and configured to engage against the enlarged end of the shift piston during at least a portion of operation of the reciprocating fluid pump.

23. The reciprocating fluid pump of claim 22, wherein the lip is integrally formed with sidewalls of the shift canister.

24. A reciprocating fluid pump, comprising: a pump body; a drive fluid chamber within the pump body; and a shift canister assembly within the drive fluid chamber for shifting flow of drive fluid during operation of the reciprocating fluid pump, the shift canister assembly comprising a shift canister that includes a first longitudinal portion that has a first outer circumference and a second longitudinal portion that has a second outer circumference that is less than the first outer circumference, wherein the shift canister assembly comprises a shift canister cap, wherein the shift canister cap comprises at least one through hole extending across a thickness thereof located to provide fluid communication between an interior of the shift canister assembly and an exterior of the shift canister assembly.

25. The reciprocating fluid pump of claim 24, wherein the shift canister cap is attached to the shift canister at a sealing end thereof.

26. The reciprocating fluid pump of claim 24, wherein the first longitudinal portion has a first outer diameter and the second longitudinal portion has a second diameter less than the first outer diameter, and a difference between the first outer diameter and the second outer diameter is between about 0.020 inch (0.5 mm) and about 0.040 inch (1.0 mm).

* * * * *